United States Patent [19]

Ho

[11] Patent Number: 4,791,994

[45] Date of Patent: Dec. 20, 1988

[54] BOOK/PAINTING/TREASURE/EQUIPMENT SAVER

[76] Inventor: I-Chung Ho, 6958 Grovespring Dr., Rancho Palos Verdes, Calif. 90274

[21] Appl. No.: 938,601

[22] Filed: Dec. 5, 1986

[51] Int. Cl.[4] ..... A62C 2/02

[52] U.S. Cl. ..... 169/48; 160/1; 169/45; 169/56

[58] Field of Search ..... 169/48–51, 169/45, 54, 56, 60, 61, 91; 160/1–3, 6–8, 84 R; 109/45, 49.5, 24, 11, 17, 18, 3, 4

[56] References Cited

U.S. PATENT DOCUMENTS

| | | | |
|---|---|---|---|
| 306,018 | 9/1884 | Johnston et al. | 109/24 |
| 535,129 | 3/1895 | Bernardin et al. | 109/24 |
| 3,687,185 | 8/1972 | Singer | 160/1 |
| 3,766,958 | 10/1973 | Mitchell | 169/48 X |
| 3,986,559 | 10/1976 | Nitu | 169/48 |
| 4,059,059 | 11/1977 | Hughes | 160/1 X |
| 4,077,474 | 3/1978 | Hattori | 160/1 X |
| 4,161,204 | 7/1979 | Kurz | 160/1 |
| 4,646,877 | 3/1972 | Ellis | 160/1 X |

FOREIGN PATENT DOCUMENTS

| | | | |
|---|---|---|---|
| 2650274 | 5/1978 | Fed. Rep. of Germany | 169/48 |
| 1591612 | 6/1981 | United Kingdom | 169/48 |

*Primary Examiner*—Joseph F. Peters, Jr.
*Assistant Examiner*—James M. Kannofsky

[57] ABSTRACT

A device having a fire resistant curtain attached to a base plate and a deployable curtain which is activated in the event of a fire in order to protect books, paintings, art treasures, etc. from fire, water, smoke and heat damage. The base plate is positioned so that it is situated above the objects to be protected. The curtain is sized so that in its deployed state it surrounds the object and extends from the base plate to the floor of the building in which the object is located.

20 Claims, 5 Drawing Sheets

3 - A

3 - B

BOOK/PAINTING/TREASURE/EQUIPMENT SAVER

BACKGROUND AND SUMMARY OF THE INVENTION

This invention relates to fire protection equipment and more particularly to a device to protect books, printings, art treasures or equipment in the event of a fire.

All too often, the heaviest damage done to books, paintings, museum treasures and delicate machinery, during library, art gallery, museum, and other building fires is not from fire itself but from water and smoke. Water has been and still will be the basic agent used to fight those fires. Unfortunately, water is also the major enemy of books, paintings, museum objects and delicate machinery such as computers and magnetic tapes. Presently, some of those water and smoke damaged articles can be saved and restored, however, the costs of the restoration are very high and many of the damages are permanent. Although almost all masterpieces are insured against lost or damage due to fire or theft, they are one of a kind items and once they are destroyed by water during fire, that is the end of that article. The insurance money can only compensate against monetary losses. One would only wonder how can we afford for so long to risk one of a kind priceless books, paintings, and treasures to such a great danger without doing something to protect them.

The present invention will protect those articles against water and smoke damage and will afford limited protection against fire and heat damage in the event of a fire disaster. A fire retarded, water proof protector curtain is placed on top of those articles to be protected. When fire breaks out, the curtain is automatically deployed and covers the articles to prevent them from water and smoke damage. This protection curtain can be a low cost standard production package for general library usage. It can also be a custom designed package to compliment the interior design of a fine art gallery or a modern art museum. This will be the cheapest insurance protection against those damages. In addition, the reduction in the regular insurance costs after the installation of this system may even pay for itself and save money in the long run.

It is an object of the present invention to provide a releasable protective curtain system in the event of a fire for books, paintings and the like.

It is another object of the invention to provide a device which is used in association with existing fire alarm devices.

It is a further object of this invention to provide a protective curtain which is fire and water resistant.

It is a further object of this invention to control the rate of deployment of the protective curtain.

In accordance with the present invention a protective curtain assembly is positioned atop or over an article(s) to be protected against loss via fire. The curtain assembly is deployed in the event of a fire, guards against fire and smoke damage and also affords protection against water damage due to the efforts to extinguish the fire.

The protective curtain assembly comprises a base plate, a curtain attached to the base plate at one end, a casing attached to the other end of the curtain and into which the curtain is folded when not in use, and a deployment mechanism for releasing the curtain and casing so that the curtain covers the object of value in the event of a fire. The protective curtain assembly further includes two safety features to prevent injury to anyone situated beneath the curtain when it deploys. The first is protective padding along the bottom of the casing and the second is a spool having one end of a safety cable wrapped therearound, and the other end extending through a series of pulleys at each corner of the casing. In this manner, when the casing is released from the base plate, safety cable is unwound from the spool at a predetermined rate to allow time for an individual to move away from under the curtain.

DESCRIPTION OF THE INVENTION

Figure 1:
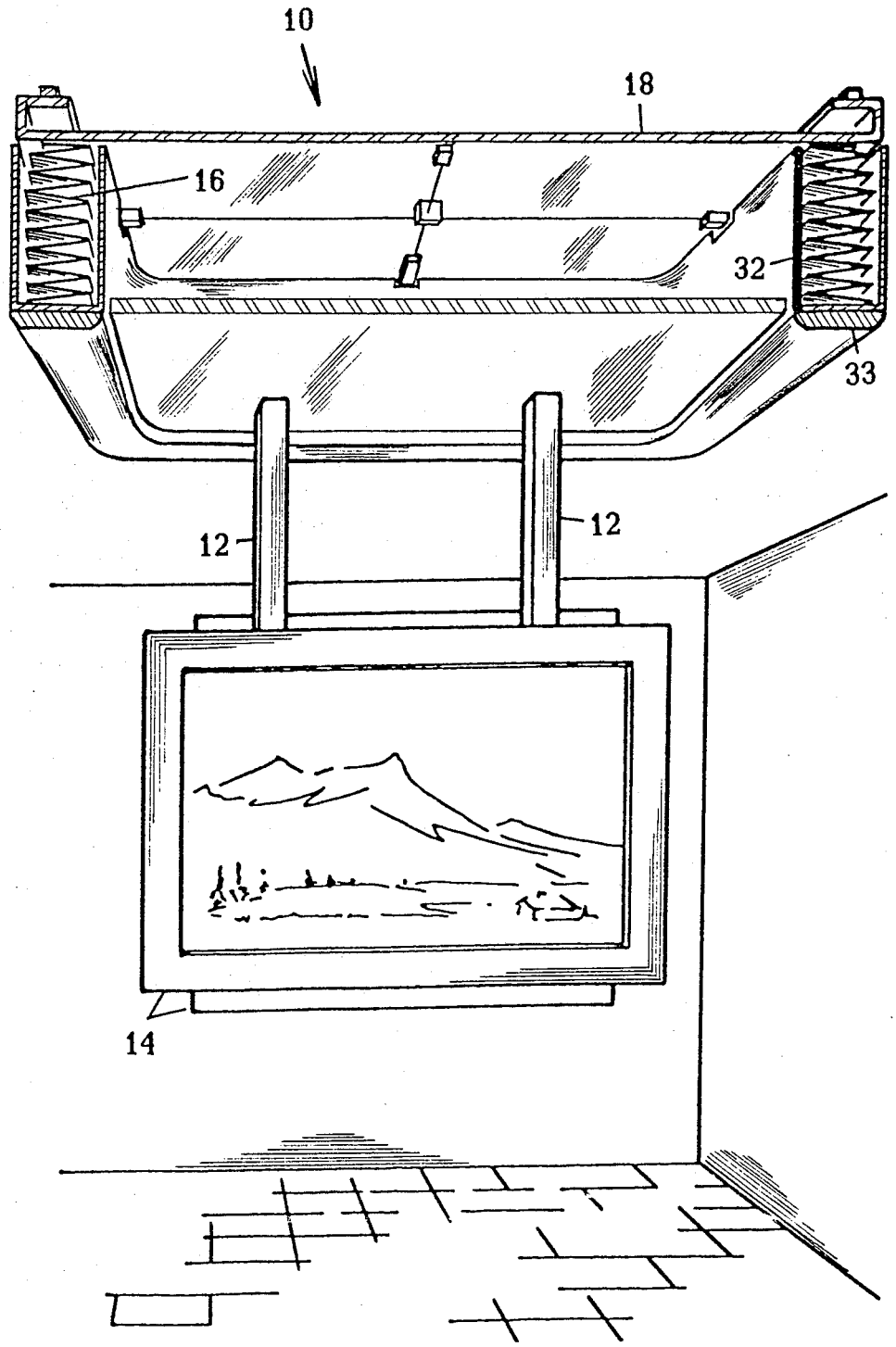
FIG. 1 is a view of the fire/water protection curtain of the present invention in its retracted position.

Shown in FIG. 1 is a protective curtain assembly 10 of the present invention. As shown, the protective curtain assembly 10 is attached to support bar or poles 12 on which is hung an article to be protected (i.e. paintings 14). In its preferred embodiment, protective curtain assembly 10 comprises a base plate 18, a curtain 16, a casing 32, and a deployment mechanism generally designated by the number 20 and best seen in FIGS. 4 and 5. When a fire breaks out anywhere in the building, the curtain 16 and casing 32 will automatically deploy, as will be discussed below, and cover the paintings 14 from the top of the painting to the floor. In this manner curtain 16 will surround the article and thus prevent water and smoke damage.

Figure 2:
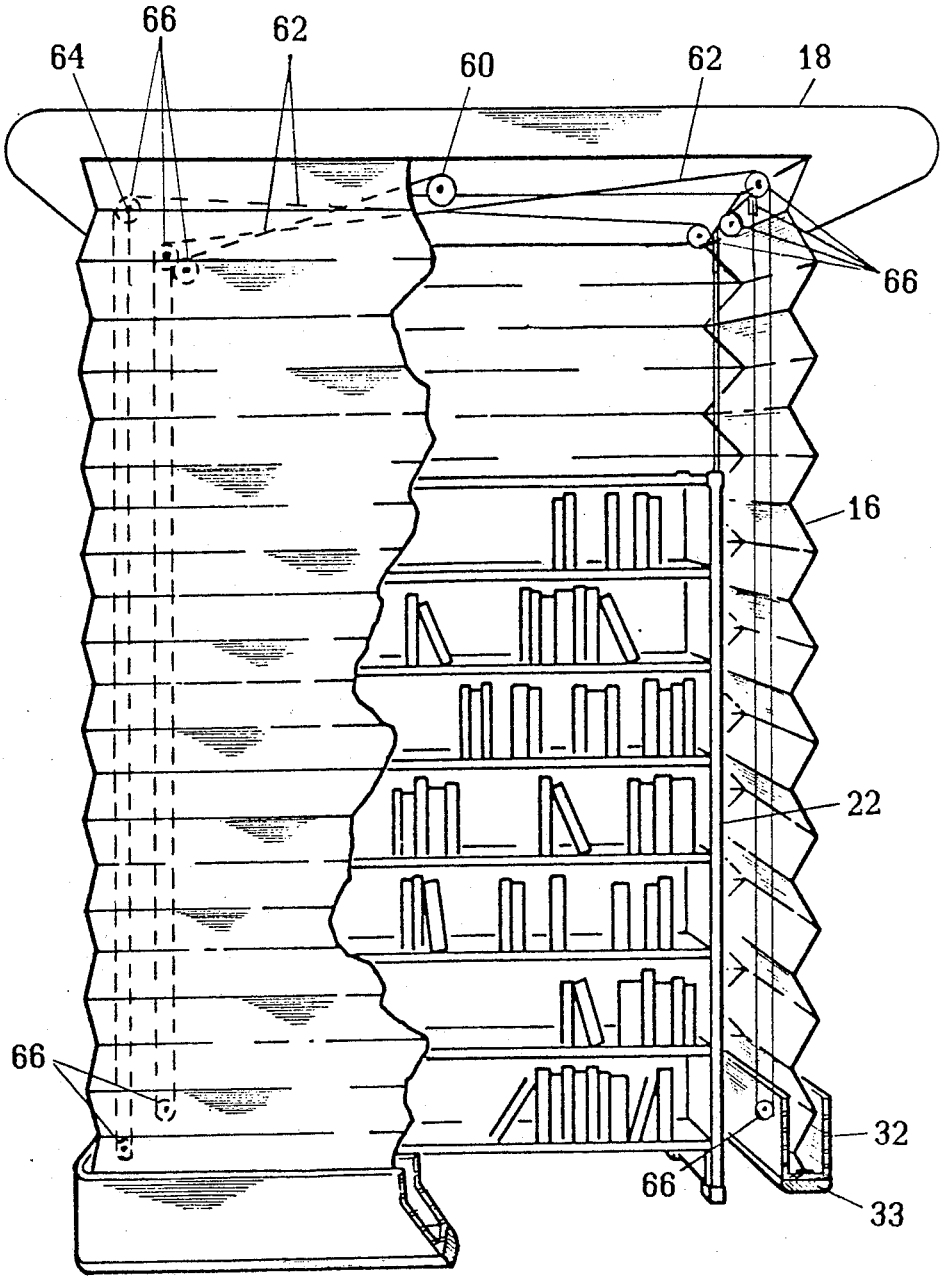
FIG. 2 is a view of the present invention in its deployed condition over a bookcase.

FIG. 2 shows the protective curtain 16 in its deployed state over a bookcase 22. The protective curtain assembly 10 can be either attached to the ceiling directly above the bookcase or to the top of the bookcase itself. Furthermore, since the present invention will be used in libraries, museums and the like it is envisioned that the protective curtain will be custom designed so that in its retracted condition it is aesthetically pleasing to the user of the building, for example it can be designed to be part of a suspended ceiling.

Figure 3:
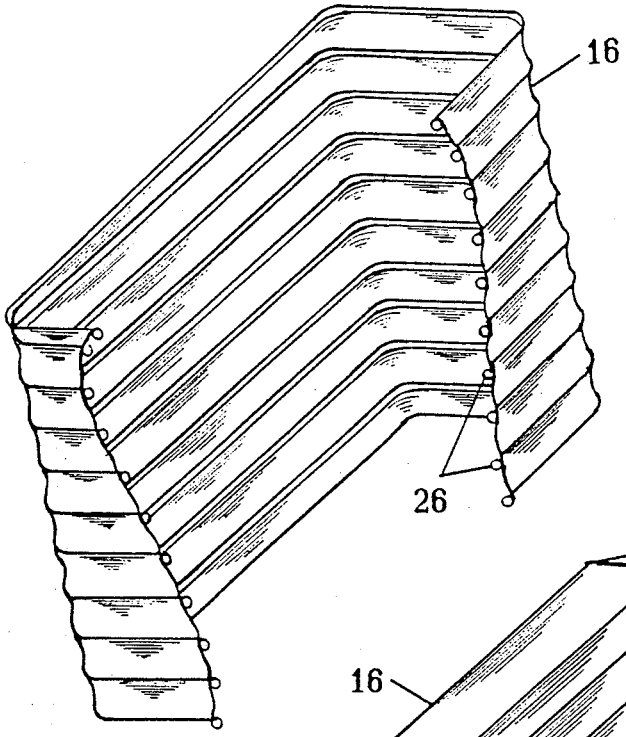
FIG. 3 is a perspective view of a coil type curtain and a bellows type curtain.
Figure 3:
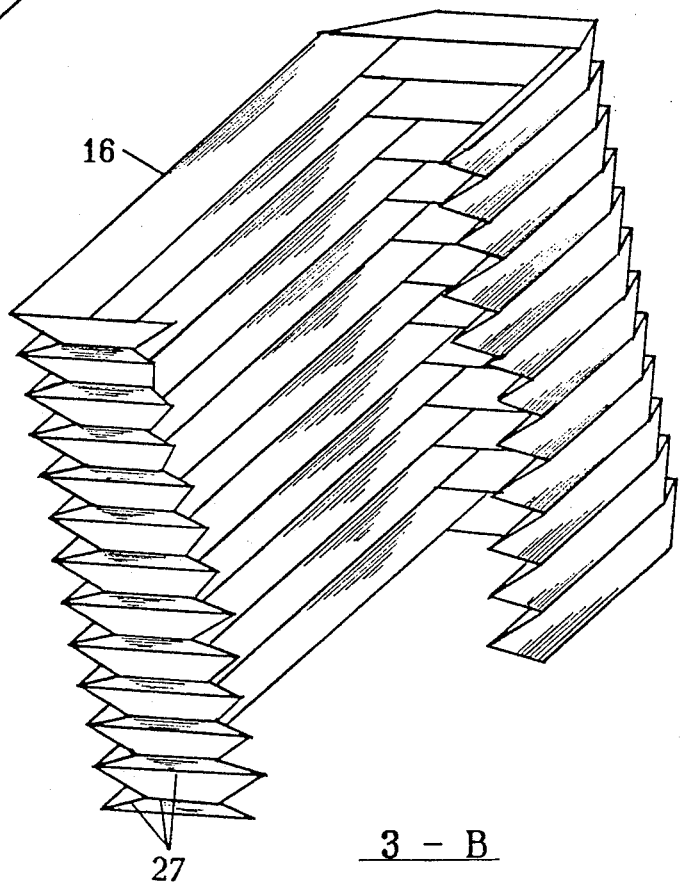

As shown, base plate 18 is a flat plate to which the deployment mechanism 20 (FIGS. 4 and 5) is attached. Plate 18 should be constructed of any flame resistant material which has the requisite structural strength or reinforced by a frame structure to support the weight of the curtain 16 and deployment mechanism 20. The curtain 16 is made of any suitable material which meets the necessary requirements of being fire retardant, water, heat and smoke resistant. It may be multi-layered and include a insulation material to provide the necessary heat and fire protection. Samples of suitable materials include FIBERFRAX ceramic fiber papers, an insulation material available from the Carborundum Corporation and flame resistant multi-ply aluminum foil laminates. In addition, curtain 16 should be flexible enough to be folded in a manner suitable for deployment. FIG. 3 shows two samples of commonly used folding methods. FIG. 3A shows a rounded corner rectangular coil type curtain with wire 26 imbeded for extra strength and FIG. 3B shows a rectangular, bellows type curtain including corrugations 27 for easy folding.

Figure 4:
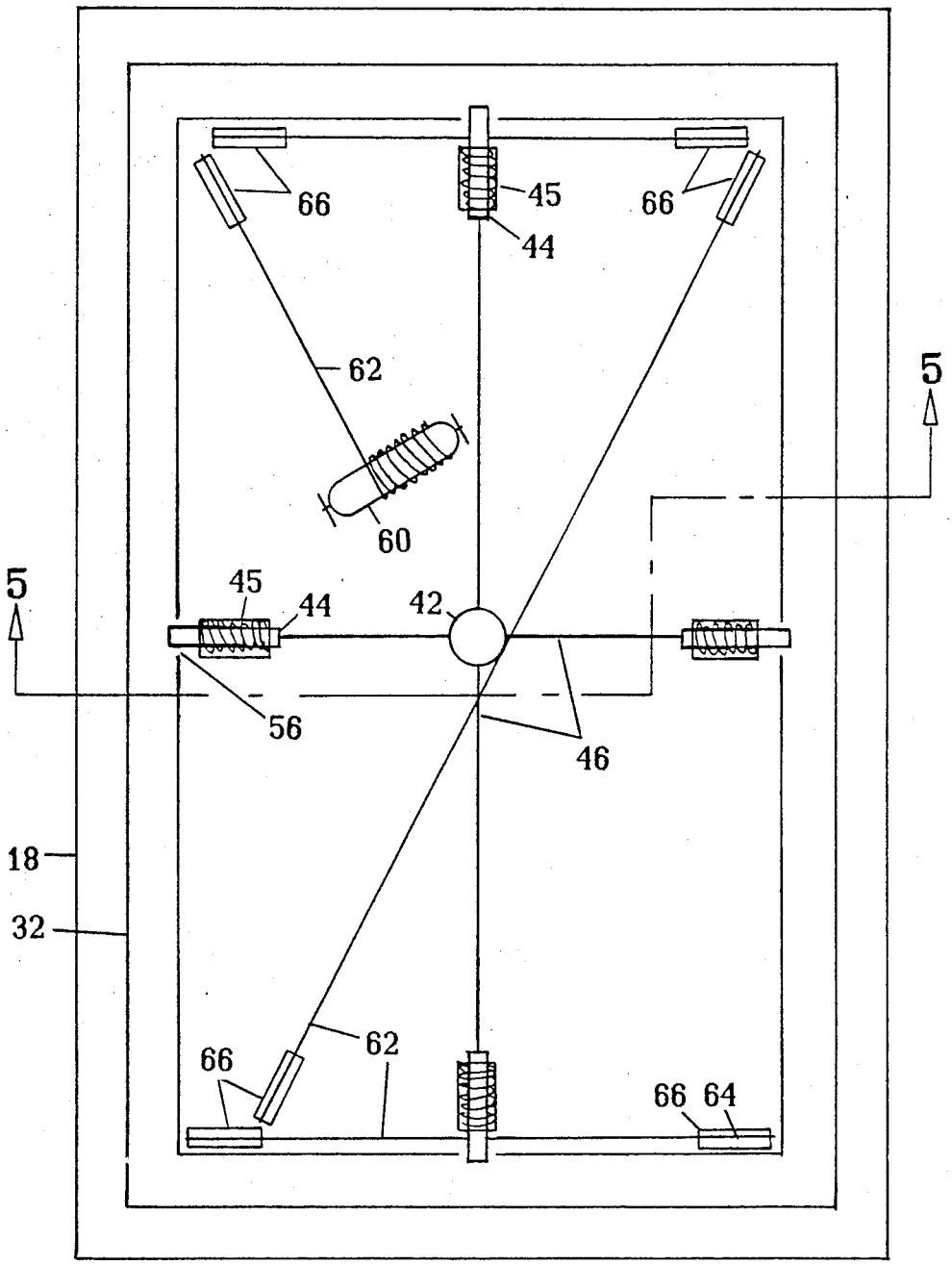
FIG. 4 is a top plan view of the protective curtain of the present invention.
Figure 5:
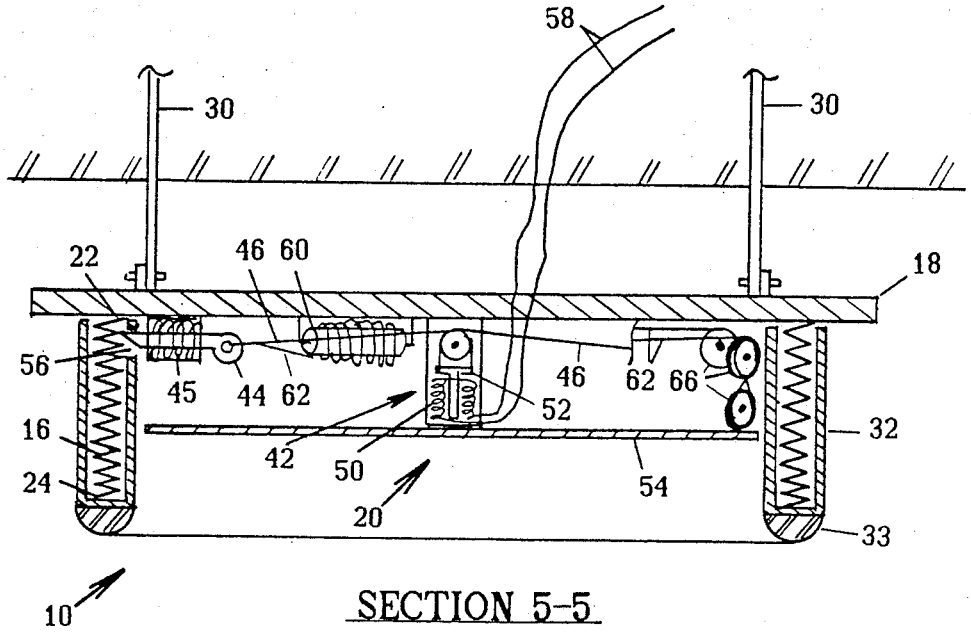
FIG. 5 is a cross-sectional view of the protective curtain taken along line 5—5 of FIG. 4.

Shown in FIGS. 4 and 5 is the protective curtain assembly 10 which includes the base plate 18, curtain 16 and the deployment mechanism 20. As shown, the base plate 18 is of suitable size for the area to be protected. Base plate 18 can be either attached to bookcase or the like or be supported from the ceiling by support bars 30 above the object to be protected. One end 22 of the curtain 16 is attached to the base plate 18 while the other or bottom end 24 of the curtain is attached to the inside of a casing 32. In its preferred design, casing 32 generally has a U-shaped cross section. In this manner, when the curtain 16 is in its folded condition (FIG. 5), the entire curtain is stored inside of the U-shaped casing 32. The bottom portion of casing 32 should be soft or include a soft padding 33 while the sides need only be strong enough to retain the curtain in its folded condition, both are preferably fire retardant.

The means for deploying the curtain or the deployment mechanism 20 comprises a solenoid valve 42, spring loaded latches 44 and cables 46. Solenoid valve 42 generally includes a wire coil 50 and a plunger 52. Plunger 52 is attached to cables 46 which extend to the latches 44. Each side of the curtain 16 has one or more latches thereon. A spring 45 loads the latch 44 into a cut-out or slot 56 in casing 32 in order to suspend the casing and hold the curtain 16 retracted within the casing 32. As shown, there are four latches 44 used with the protective curtain assembly 10 depicted, however, it is envisioned that with a protective curtain assembly 10 which is mounted against a wall and has only three sides, the wall acts as the forth side, fewer latches 44 may be needed. A cover plate 54 attached to base plate 18 encloses and protects the deployment mechanism.

In operation, when a central control station detects a fire or a manual fire alarm is pulled, an electrical signal 58 is sent to the solenoid valve 42. The plunger 52 simultaneously pulls all the cables 46. Latches 44 are then pulled out of cut-outs 56 which then releases the curtain casing 32. The weight of the curtain 16 and casing 32 will act to unfold the curtain 16 as shown in FIG. 2. In this manner, it is only important that the curtain 1 extend to the floor.

In addition, the protective curtain assembly 10 may include a safety device which controls the rate of descent of the curtain 16 and casing 32 once released. Shown is a spool 60 having a safety cable 62 wound thereon. Safety cable 62 is routed through a series of pulleys 66 located at each corner of the casing 32 and base plate 18. Safety cable 62 is secured to base plate 18 at its end 64. The spool 60 releases the cable 62 at a pre-designed rate which slows down the lowering rate of the curtain. This will allow any person under the curtain to escape to safety without being trapped inside the curtain.

Additionally, a second release mechanism (not shown) may be added as an option to lower the base plate after the curtain has been fully deployed. This will allow the protective curtain to drop to the lowest position thus reducing its exposed surface area and therefore minimize its fire and water damage.

While the present invention has been described with respect to exemplary embodiments thereof, it should be understood that various changes and modifications to the preferred embodiments described above will be apparent to those skilled in the art without departing from the scope of the present invention.

I claim:

1. A protective curtain assembly for protecting an article of value against damage, said assembly comprising:

a base plate located above said article;

a foldable fire resistant curtain attached at one end to the perimeter of said base plate; and means for deploying said curtain such that in its deployed state it is unfolded and surrounds said article extending from said base plate to the floor.

2. A protective curtain assembly for protecting an article of value against damage, said assembly comprising:

a base plate located above said article;

a fire resistant curtain attached at one end to the perimeter of said base plate;

a casing, releasably attached to said base plate, within which said curtain is stored when not deployed; and means for deploying said curtain such that in its deployed state it surrounds said article.

3. The assembly of claim 2 wherein one end of said curtain is attached to said casing.

4. The assembly of claim 3 wherein said casing has a generally U-shaped cross-section.

5. The assembly of claim 4 wherein said end of said curtain which is attached to said casing is attached on the inside bottom of the casing.

6. The assembly of claim 5 wherein said curtain is generally attached around the perimeter of said base plate and has a length sufficient to extend from said base plate to the floor.

7. The assembly of claim 2 wherein said casing includes a padding on the bottom thereof.

8. The assembly of claim 1 further including a cover plate attached to said base plate such that said means for deploying is located between said base plate and said cover plate.

9. The assembly of claim 8 wherein said cover plate is sized to fit within the casing.

10. The assembly of claim 2 further including a safety means for controlling the rate of deployment of said curtain.

11. The assembly of claim 10 wherein said safety means comprises:

pulley attached to said casing and base plate at each corner thereof;

a spool attached to said base plate; and a safety cable run through each pulley and having one end attached to one corner of said casing and the other to said spool.

12. The assembly of claim 1 wherein said means for deploying comprises:

a solenoid valve including a plunger movable by electrical input to said solenoid valve;

at least one spring loaded latch, said latch extending into an opening in said casing;

a cable extending between said plunger and each of said at least one latches; and an electronical input to said solenoid valve.

13. A protective curtain system for surrounding an article of value in the event of a fire, said system comprising:

a base plate suspended above said article;

a fire resistant curtain attached at one end to the underside of said base plate;

a casing attached to the other end of said curtain, said casing including at least one opening therein;

a solenoid valve;

at least one spring loaded latch extending into said opening in said casing; and a cable extending between said solenoid valve and each of said latches.

14. The system of claim 13 wherein said curtain is constructed of a flexible, foldable, fire resistant material.

15. The system of claim 14 wherein said curtain is attached generally around the perimeter of said base plate and has a length to extend from said base plate to the floor in its deployed state.

16. The system of claim 13 wherein said base plate is rectangularly shaped and is attached to a wall above said article of value and said curtain extends along three sides of said base plate.

17. The system of claim 13 wherein said base plate is attached to support bars to which the article of value is attached and said curtain extends around the base plate near its perimeter.

18. The system of claim 13 wherein said system further includes a cover plate attached to said base plate so that said solenoid valve and at least one spring loaded latch is between said base plate and cover plate.

19. The method of protecting an article of value in the event of a fire comprising the steps of:

mounting a base plate above said article;

attaching one end of a curtain to said base plate;

folding a fire resistant curtain in a casing;

releasably securing said casing to said base plate;

releasing said casing from said base plate in the event of a fire.

20. The method of claim 19 further including the step of controlling the rate of deployment of the curtain.

* * * * *